United States Patent [19]

Roth et al.

[11] 4,190,751

[45] Feb. 26, 1980

[54] ELECTRICAL CONTACT SWITCH WITH AN EXTREMELY SMALL ACTUATING MOVEMENT

[76] Inventors: Jac M. Roth; Veronika Roth nee Werner, both of Sandbuechel 26a, D-506 Bensberg-Refrath, Fed. Rep. of Germany

[21] Appl. No.: 734,639

[22] Filed: Oct. 21, 1976

[30] Foreign Application Priority Data

Oct. 22, 1975 [DE] Fed. Rep. of Germany ..... 2547257

[51] Int. Cl.[2] ..... H01H 5/20

[52] U.S. Cl. ..... 200/67 DB; 200/159 A

[58] Field of Search ..... 200/67 D, 67 DA, 67 DB, 200/159 R, 159 A

[56] References Cited

U.S. PATENT DOCUMENTS

| | | | |
|---|---|---|---|
| 2,599,437 | 6/1952 | Dickson | 200/67DB |
| 3,067,301 | 12/1962 | Yamamoto | 200/67 DB |
| 3,699,296 | 10/1972 | Harris | 200/67 DB |
| 3,873,078 | 3/1975 | Wolf | 200/67 DB |
| 4,002,871 | 1/1977 | Sims, Jr. | 200/67 DB |

*Primary Examiner*—Harold J. Tudor

*Attorney, Agent, or Firm*—Michael J. Striker

[57] ABSTRACT

A leaf spring contact with endwise applied actuation movement is provided with a leaf spring body having two ends, at least one contactor located upon the center of said leaf spring body and two inflexible and laterally immovable anchors, each fastened to a different end of said leaf spring body. Means are connected to at least one of said anchors for directing a compressive force through said one anchor towards the center of said leaf spring body and for, consequently, inducing a transgression of bending stress of said leaf spring body which then suddenly bends in a whip-like fashion resulting in switch motion of said leaf spring body.

5 Claims, 1 Drawing Figure

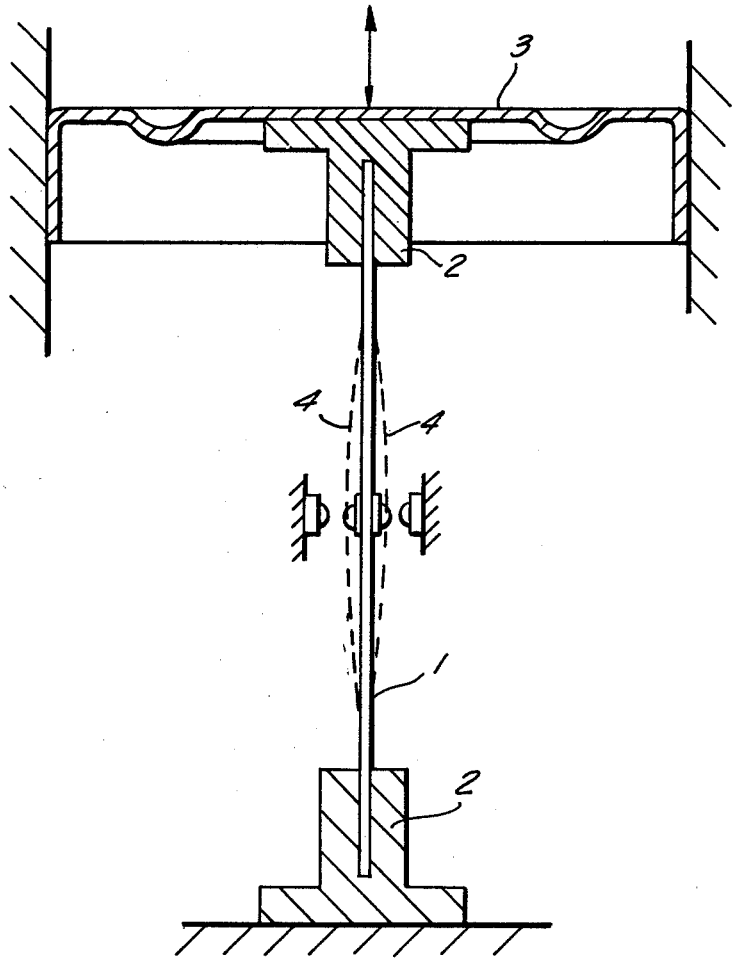
3
2
4
4
1
2

ELECTRICAL CONTACT SWITCH WITH AN EXTREMELY SMALL ACTUATING MOVEMENT

BACKGROUND OF THE INVENTION

The invention relates to a leaf spring contact with an endwise applied actuating movement. Such contact switches have verstaile applications in circuit, control, and automatic control technology. They are particularly distinguished by their completely physical separation in contrast to contactless switches.

Already known contact systems are mounted at the ends of leaf spring contacts in so-called knife edge suspensions for free lateral movement. With these contacts, there occurs a deflection proportional to the endwise applied actuating movement. (U.S. Pat. Nos. 3,109,901 as well as 3,284,594).

A technologically desirable sudden bending and consequently abrupt switching action do not occur. Additionally disadvantageous is the large bending radius of such conventional arrangements, which causes the curvature to proceed from the knife edge suspension, and under the action of external friction a great wearing and disadjustment is produced; at least these problems accompany the conventionally known contact systems.

SUMMARY OF THE INVENTION

The attainable conversions from switching movement to actuating movement, are limited to known ratios and do not promise newer and simpler prospective applications.

The invention solves the problem of providing a mechanical contact switch, which in its method of operation eliminates the generally known disadvantages, which are caused by external friction points ascribable to bearings, joints, hinges and the like resulting in more wear and tear and operational unreliability.

In connection with this desirable object, the novel switch element should nevertheless also be capable of reacting with such sensitivity, under application of sufficient contact pressure as well as switch stability, that for example a minimal linear expansion ascribable to warming of solid-state bodies is experienced, or such that the element can be used for relay contact applications with practically no air gaps being formed between the two unipolar and mutually repulsive magnets serving as the actuating element. Finally, it is possible to perform the actuation with a piezo-crystal as actuating element instead of an electromagnet, with the piezocrystal in an inversion of the piezoelectric effect producing a pressure pulse through application thereto of a voltage. Such a switch element comprehends many novel applications and should be distinguished in its production by simplicity and also an extremely small number of component parts.

According to the present invention, this switch element comprises a leaf spring having a strength, shape and length dependent upon the intended use and directly carrying the contacts and closing upon performance of its closing motion.

BRIEF DESCRIPTION OF THE DRAWING

The single FIGURE shows the leaf spring contact 1 which has on each of its two ends a completely rigid anchor 2.

The anchors 2 in turn are laterally immovable and are concentrically fixed in for example a surrounding housing, so that the direction of actuation proceeds endwise exactly in the direction of the longitudinal axis of the producing leaf spring. In the drawing for example this is achieved in a very simple manner without external friction points by means of a diaphragm 3, which permits no lateral deflection. According to the invention, the desired extremely high ratio between the actuating distance along the longitudinal axis and the switching distance at the switching contact will be made possible by the fixed anchoring at both ends and by the longitudinal axially symmetric application of the actuating force and is produced by the consequent sudden bending stress and by the sudden bending resulting upon transgression beyond this stress in the middle region of the spring contact.

Moreover, the varying sudden bending characteristics known from mechanics or physics result precisely from the rigid and therefore inflexible or movable holding of the bending rod. Publications taken into consideration:

U.S. Pat. No. 3,109,901
U.S. Pat. No. 3,284,594

We claim:

1. A movable leaf spring contact engageable with a fixed contact for switching the same, said leaf spring comprising a normally straight leaf spring body having two end portions and an intermediate portion therebetween; two rigid and laterally immovable anchors each rigidly embracing a different end portion of said spring so as to prevent all lateral movements of said end portions; and means connected to at least one of said anchors for directing through said one anchor and the respective end portion fastened thereto a compressive force which acts lengthwise of said spring body and towards the center of the same and for inducing a consequent transgression of bending stress of said intermediate portion of said leaf spring body which intermediate portion then suddenly bends and engages a fixed contact.

2. A leaf spring contact as defined in claim 1, wherein said directing means is a diaphragm through which the compressive force is applied under absolute lateral rigidity and without exterior friction points.

3. A spring as defined in claim 1 and further comprising at least one contactor located at the middle of said intermediate portion of the leaf spring body.

4. A leaf spring contact as defined in claim 3, wherein said contactor is directly mounted upon said leaf spring body.

5. A leaf spring as defined in claim 1, wherein at least one of said laterally immovable anchors is concentrically fixed within a surrounding housing.

* * * * *